United States Patent [19]

Green

[11] Patent Number: 4,572,510

[45] Date of Patent: Feb. 25, 1986

[54] BINGO INDICATOR

[76] Inventor: Ronald Green, 282 Thunder Cir., Bensalem, Pa. 19020

[21] Appl. No.: 670,215

[22] Filed: Nov. 7, 1984

[51] Int. Cl.[4] ..... G09F 21/02

[52] U.S. Cl. ..... 273/148 R; 40/586

[58] Field of Search ..... 273/148 R; 40/586, 601, 40/610; 116/173, 175

[56] References Cited

U.S. PATENT DOCUMENTS

| | | | |
|---|---|---|---|
| 2,882,629 | 4/1959 | Moebius | 40/610 X |
| 3,775,887 | 12/1973 | Precourt | 40/586 X |
| 3,969,837 | 7/1976 | Kresse | 40/586 X |

FOREIGN PATENT DOCUMENTS

| | | | |
|---|---|---|---|
| 707501 | 4/1965 | Canada | 40/586 |
| 489076 | 5/1970 | Switzerland | 40/586 |

*Primary Examiner*—Anton O. Oechsle
*Attorney, Agent, or Firm*—Harvey B. Jacobson; Clarence A. O'Brien

[57] ABSTRACT

A vertically elongated, hollow and lightweight housing including top and bottom walls and a plurality of interconnected sidewall portions extending between and connecting the top and bottom walls is provided. At least one of the sidewall portions has indicia thereon indicating a winning bingo game situation and the bottom wall includes a central opening formed therein about which a depending tubular neck integral with the bottom wall is disposed. An elongated wand is also provided including upper and lower ends and a mid-length portion extending between and connecting the upper and lower ends. The wand is slidingly telescopingly received through the neck and the upper and lower ends are slightly diametrically enlarged in relation to the mid-length portion of the wand. The upper and lower ends are tightly slidingly receivable through the neck and the mid-length portion of the wand is freely slidable through the neck. The lower end of the wand includes a diametrical enlargement thereon of greater transverse dimension than the outside diameter of the neck and the length of the wand is such that the upper end face thereof abuts against the inner surface of the top wall of the housing when the enlargement is in close juxtaposition with the lower end of the neck.

11 Claims, 4 Drawing Figures

BINGO INDICATOR

BACKGROUND OF THE INVENTION

1. Field of the Invention

This invention relates to a signalling indicator of the handheld sign-type and includes indicia thereon indicating a game situation achieved by the user of the indicator for ready viewing by other game participants as well as game controlling personnel.

2. Description of Related Art

Various different forms of handheld indicators and signs heretofore have been designed such as those disclosed in U.S. Pat. Nos. 2,409,957, 2,773,470, 2,947,557, 2,968,890, 3,225,734, 3,775,887, 3,969,837 and 4,172,597. However, these various different forms of signalling indicators are specifically designed to accomplish the intended functions thereof in environments different from that in which the indicator of the instant invention is designed to be used and, accordingly, do not include all of the structural and operational features of the instant invention to be set forth and described in detail hereinafter and which give rise to the advantages of operation of the instant invention in its intended environmental usage.

SUMMARY OF THE INVENTION

The indicator of the instant invention includes a vertically elongated hollow housing equipped with upper and lower walls as well as upstanding peripheral walls extending between and interconnecting the upper and lower walls. The lower wall includes an opening formed therethrough about which a depending hollow neck formed integrally with the bottom wall is disposed and an elongated wand having upper and lower ends is telescopingly received within the neck. The wand is shiftable through the neck between a retracted position substantially fully upwardly telescoped within the housing and a downwardly extended position with only the upper terminal end portion of the wand disposed in the neck and the remaining portions of the wand projecting downwardly from the housing.

Remote peripheral walls of the housing have indicia thereon in the form of the word "BINGO" with the letters of the word in vertically spaced relation and upper and lower terminal end portions of the wand are slightly diametrically enlarged and are tightly slidingly receivable through the neck while mid-length portion of the wand disposed between the upper and lower terminal end portion thereof is slightly smaller in outside diameter than the upper and lower terminal end portions of the wand and therefore is freely slidable through the neck. Also, the length of the wand is such that when the upper terminal end thereof is fully telescoped within the housing and abutted against the inner surface of the top wall of the housing, the lower terminal end of the wand projects slightly below the collar. The lower terminal end includes an enlargement thereon below the lower end of the collar and which is of a maximum outside transverse dimension greater than the outside transverse dimension of the neck.

The main object of this invention is to provide an indicator for use by a participant in a bingo game for indicating the successful completion of a bingo game by that user when the user raises his forearm and supports the lower end of the extended wand in his raised hand.

Another object of this invention is to provide an indicator in accordance with the preceding objects and which may be readily used by a bingo game participant for indicating not only to bingo game controlling personnel that a bingo game has been completed but also indicating the same game completion to other persons participating in the bingo game.

Yet another object of this invention is to provide an indicator which may be conveniently used by a bingo game participant.

A still further object of this invention is to provide an indicator of a construction which may be readily rested upon a bingo game playing surface at the ready access of the intended user of the indicator and with the indicator occupying but a small area of the playing surface.

Another object of this invention is to provide an indicator which may be readily collapsed into a compact condition for storage and transport.

A final object of this invention to be specifically enumerated herein is to provide an indicator in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
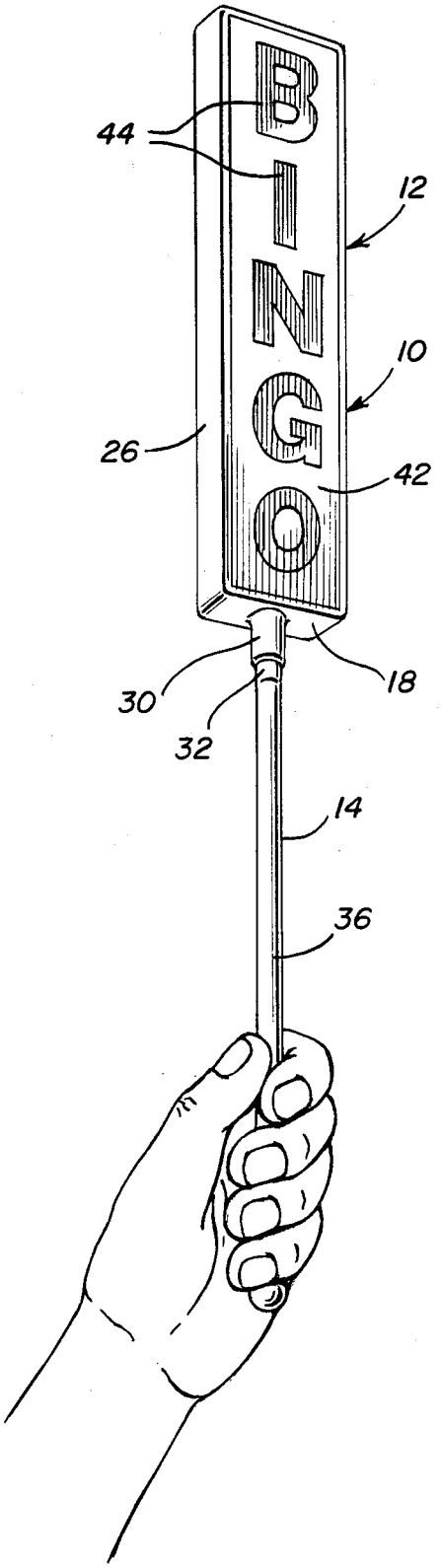
FIG. 1 is a perspective view of the indicator of the instant invention in use.
Figure 2:
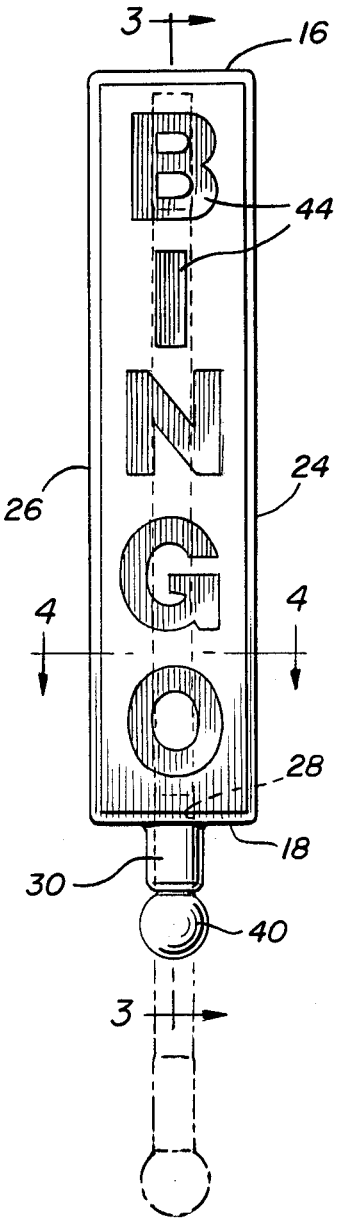
FIG. 2 is an elevational view of the indicator with the wand portion thereof in fully retracted position.

Referring now more specifically to the drawings, the numeral 10 generally designates the indicator of the instant invention. The indicator 10 includes a vertically elongated hollow housing referred to in general by the reference numeral 12 and a lengthwise extendible and retractable wand 14. The housing 12 includes top and bottom walls 16 and 18 and pairs of remote peripheral walls 20, 22 and 24, 26.

Figure 4:
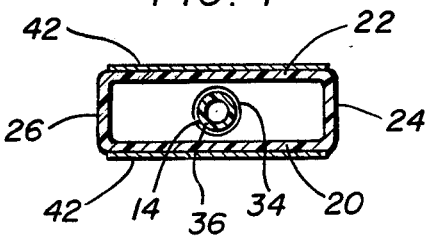
FIG. 4 is an enlarged horizontal sectional view taken substantially upon the plane indicated by the section line 4—4 of FIG. 2.

The bottom wall 18 includes a central opening 28 formed therein and an integral depending hollow cylindrical neck 30 depending downwardly therefrom about the opening 28. Accordingly, the neck 30 opens upwardly into the interior of the housing 12 through the opening 18 and it will be noted from FIGS. 1 and 4 that the walls 20 and 22 are of considerably greater width than the walls 24 and 26.

The wand 14 includes upper and lower end portions 32 and 34 and a mid-length portion 36 integral with and extending between the end portions 32 and 34. The mid-length portion 36 is substantially cylindrical, as are the end portions 32 and 34, but the end portions 32 and 34 are each slightly larger in outside diameter than the mid-length portion 36.

Figure 3:
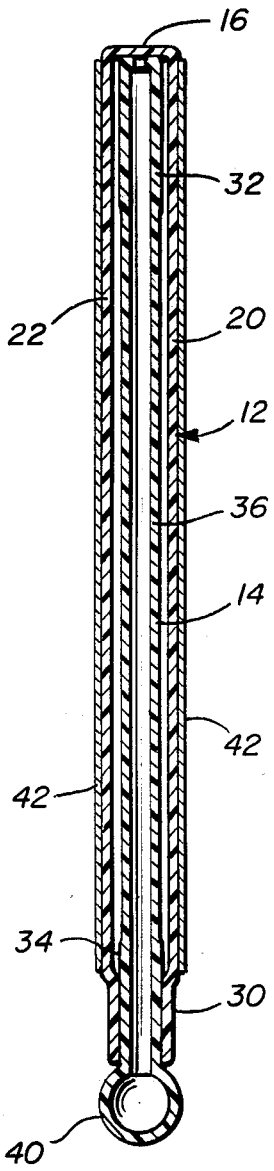
FIG. 3 is an enlarged vertical sectional view taken substantially upon the plane indicated by the section line 3—3 of FIG. 2.

As may be seen from FIGS. 1 and 3 of the drawings, the wand 14 may be shifted between a fully extended position such as that illustrated in FIG. 1 with the upper end portion 32 extending through the neck 30 and a fully retracted position such as that illustrated in FIG. 3 with the lower end portion 34 extending through the neck 30. The lower end portion 34 includes a partial spherical enlargement 40 which is of a maximum transverse dimension greater than the outside transverse dimension of the neck 30 and which abuts upwardly against the lower end of the neck 30 when the upper end face of the upper end portion 32 abuts against the inner surface of the top wall 16.

The housing 12 is constructed of plastic which is shape retentive but somewhat deformable and the upper and lower end portions 32 and 34 are of diameters which enable the upper and lower end portions 34 to be tightly slidingly received within the neck 30. The tight fit between the upper and lower end portions 32 and 34 enables the wand 14 to be frictionally retained in either the extended position thereof illustrated in FIG. 1 or the fully retracted position thereof illustrated in FIG. 3. Accordingly, when the indicator 10 is in use, the housing 12 will not fall from or downwardly along the wand 14 and when the indicator 10 has been collapsed for compact storage and transport, the wand 14 will not fall from the neck 30. However, as soon as the wand 14 has been shifted from either the fully extended position of FIG. 1 or the fully retracted position of FIG. 3 and the mid-length portion 36 of the wand 14 extends through the neck 30, the wand 14 is freely slidable through the neck.

Accordingly, a person preparing to use the indicator 10 may grip the housing 12 in one hand and the enlargement 40 in the other hand in order to forcibly shift the wand 14 from the fully retracted position of FIG. 3 toward the fully extended position of FIG. 1 and when the wand 14 approaches its fully retracted position and the upper end portion 32 begins to slide downwardly through the neck 30, the increased resistance to sliding movement of the wand 14 relative to the neck 30 constituting an indication to the user of the indicator 10 that the wand 14 is almost fully extended. Thus, the user need only slightly further extend the wand 14 in order to reasonably tightly frictionally retain the wand 14 in its extended position for ready usage of the indicator 10. On the other hand, when the user of the indicator 10 desires to retract the wand 14 from the extended position thereof of FIG. 1 to the retracted position of FIG. 3 inward movement of the wand to a point just before the fully retracted position of the wand 14 will be met with increased resistance, indicating to the user that the wand 14 is almost fully retracted.

Inasmuch as the upper end of the wand 14 abuts the inner surface of the top wall 16 at substantially the same time the enlargement 40 moves into close proximity to the lower end of the neck 30, it is impossible to inwardly retract the wand 14 past the retracted position thereof illustrated in FIG. 3. Therefore, the enlargement 40 may not be wedged into the lower end of the neck 30, which wedging action might cause damage to the neck 30.

The sidewalls 20 and 22 each include an indicator sheet 42 adhesively secured thereover. The indicator sheets 42 include indicia 44 thereon in the form of vertically spaced letters which spell the word "BINGO". Of course, the color of the sheets 42 and the indicia 44 are contrasting to thereby enable the indicia 44 to be readily viewed. Further, it is preferable, although not imperative, that the housing 12 and wand 14 be constructed of a dark color plastic and that the sheets 42 be lightly colored such as white with the indicia 44 being a bright contrasting color such as red.

The length of the housing 12 and the wand 14 is such that when the wand 14 is fully extended the overall length of the indicator 10 is approximately 2 feet. In this manner, a person sitting at a bingo table and wishing to signal his successful completion of the bingo game need only grasp the wand 14 by the lower end thereof and raise only his forearm to a generally upright position. This will place, at least substantially, the entire length of the housing 12 above the head of the user, depending upon the height of the playing surface relative to the user.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bingo indicator including a vertically elongated hollow and lightweight housing including top and bottom walls and a plurality of interconnected sidewall portions extending between and connecting said top and bottom walls, at least one of said sidewall portions having indicia thereon indicating a winning bingo game situation, said bottom wall including an integral downwardly opening depending tubular neck opening upwardly into the interior of said housing, an elongated wand including upper and lower ends, said wand being slidingly telescopingly received through said neck and shiftable relative thereto between a retracted position substantially fully upwardly telescopingly received within said housing with only the lower terminal end portion of said lower end projecting downwardly below said neck and an extended position with the upper terminal end portion of said wand disposed in said neck and the remaining portions of said wand disposed therebelow projecting downwardly from said neck, said upper and lower terminal end portions of said wand being slightly enlarged in cross-sectional dimension relative to the cross-sectional dimension of the mid-length portion of said wand extending between said upper and lower terminal end portions with said mid-length portion being freely slidable through said neck and said terminal end portions being somewhat tightly slidingly receivable in said neck, whereby said wand is frictionally retained in the retracted position as well as the extended position thereof and may slide freely relative to said neck between said retracted and extended positions.

2. The indicator of claim 1 wherein said lower terminal end portion of said wand includes an enlargement thereon of greater outside dimension than the outside dimension of said neck.

3. The indicator of claim 1 wherein said wand is of a length such that the upper end face thereof abuts the inner side of said top wall when said wand is in said retracted position.

4. The indicator of claim 3 wherein said lower terminal end portion of said wand includes an enlargement thereon of greater outside dimension than the outside dimension of said neck.

5. The indicator of claim 1 wherein said neck is internally substantially cylindrical and said terminal end portions and mid-length portion are externally substantially cylindrical.

6. The indicator of claim 1 wherein said sidewall portions include a pair of substantially oppositely facing sidewall portions each having said indicia thereon.

7. The indicator of claim 6 wherein said pair of sidewall portions are of greater width than the remaining sidewall portions of said housing.

8. The indicator of claim 7 wherein said wand is of a length such that the upper end face thereof abuts the inner side of said top wall when said wand is in said retracted position.

9. The indicator of claim 8 wherein said lower terminal end portion of said wand includes an enlargement thereon of greater outside dimension than the outside dimension of said neck.

10. The indicator of claim 9 wherein said neck is internally substantially cylindrical and said terminal end portions and mid-length portion are externally substantially cylindrical.

11. The indicator of claim 1 wherein said indicia form the word "BINGO" with the letters of said word vertically spaced apart along said one sidewall portion.

* * * * *